US005860845A

United States Patent [19]

Goyhrach

[11] Patent Number: 5,860,845

[45] Date of Patent: Jan. 19, 1999

[54] LUMINESCENT BALLOON

[76] Inventor: Yuval Goyhrach, 7 Manya Shochat, Rishon Lezion, Israel

[21] Appl. No.: 779,826

[22] Filed: Jan. 7, 1997

[51] Int. Cl.[6] ..... A63H 33/22; A63H 27/10

[52] U.S. Cl. ..... 446/219; 362/34; 446/220

[58] Field of Search ..... 446/219, 220, 446/221

[56] References Cited

U.S. PATENT DOCUMENTS

| | | | |
|---|---|---|---|
| 2,625,770 | 1/1953 | Steen et al. | 446/21 |
| 3,350,553 | 10/1967 | Cline | 362/34 |
| 3,800,132 | 3/1974 | Postal | 362/34 |
| 3,980,300 | 9/1976 | Hornsby, Jr. | 446/219 X |
| 4,015,111 | 3/1977 | Spector | 446/220 X |
| 4,884,990 | 12/1989 | Lovik | 446/220 |
| 4,930,776 | 6/1990 | Newcomb et al. | 446/219 X |
| 4,986,540 | 1/1991 | Leslie | 273/58 |
| 5,639,076 | 6/1997 | Cmiel et al. | 446/220 X |

*Primary Examiner*—Robert A. Hafer
*Assistant Examiner*—Michael B. Priddy
*Attorney, Agent, or Firm*—Mark M. Friedman

[57] ABSTRACT

A toy consists of an inner balloon and a transparent outer balloon that define a chamber therebetween. The chamber is substantially filled by a first liquid and one or more fragile capsules containing a second liquid. The first liquid and the second liquid have the property that when they are mixed, a mixture is created that glows for several hours. The capsule (s) are broken, releasing the second liquid, and the toy is inflated, creating a balloon that glows in the dark.

5 Claims, 3 Drawing Sheets

FIG.1 - PRIOR ART

LUMINESCENT BALLOON

FIELD AND BACKGROUND OF INVENTION

The present invention relates to toys, and, more particularly, to toys that glow in the dark.

FIG. 1 is a cross-sectional view of the prior art relative to the present invention: a hollow flexible sealed transparent plastic tube 10, such as is commonly sold for example at amusement parks and sports stadiums, or given out at parties. Substantially filling tube 10 is a first liquid 20. Inserted in one end of tube 10 is a fragile capsule 12 containing a second liquid 22. When capsule 12 is broken or torn, second liquid 22 mixes with first liquid 21, initiating a chemical reaction having one or more luminescent products that cause tube 10 to glow for several hours. The ends of tube 10 typically are provided with a mechanism that allows the ends of tube 10 to be joined one to the other, forming a necklace that the user can wear. In the specific example shown in FIG. 1, one end of tube 10 is provided with a male member 14 and the other end of tube 10 is provided with a female member 16. Inserting male member 14 into female member 16 closes tube 10 into a loop.

Typical examples of first liquid 20 and second liquid 22 are luminol (5-amino-2,3-dihydro-1,4-phthalazinedione) and hydrogen peroxide, respectively. One example of the prior art device is the "Laser Glow Light" marketed by Topstone Industries of Danbury, Conn.

SUMMARY OF THE INVENTION

According to the present invention there is provided A toy comprising: (a) an inner balloon; (b) an outer balloon, substantially enclosing said inner balloon, said inner balloon and said outer balloon defining a chamber therebetween; (c) a first liquid, within said chamber; (d) a capsule, within said chamber; and (e) a second liquid, within said capsule, said first liquid and said second liquid being such tat when said first liquid and said second liquid are mixed, a glowing mixture is formed.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of a toy balloon that glows in the dark.

The principles and operation of a toy balloon according to the present invention may be better understood with reference to the drawings and the accompanying description.

Figure 1:
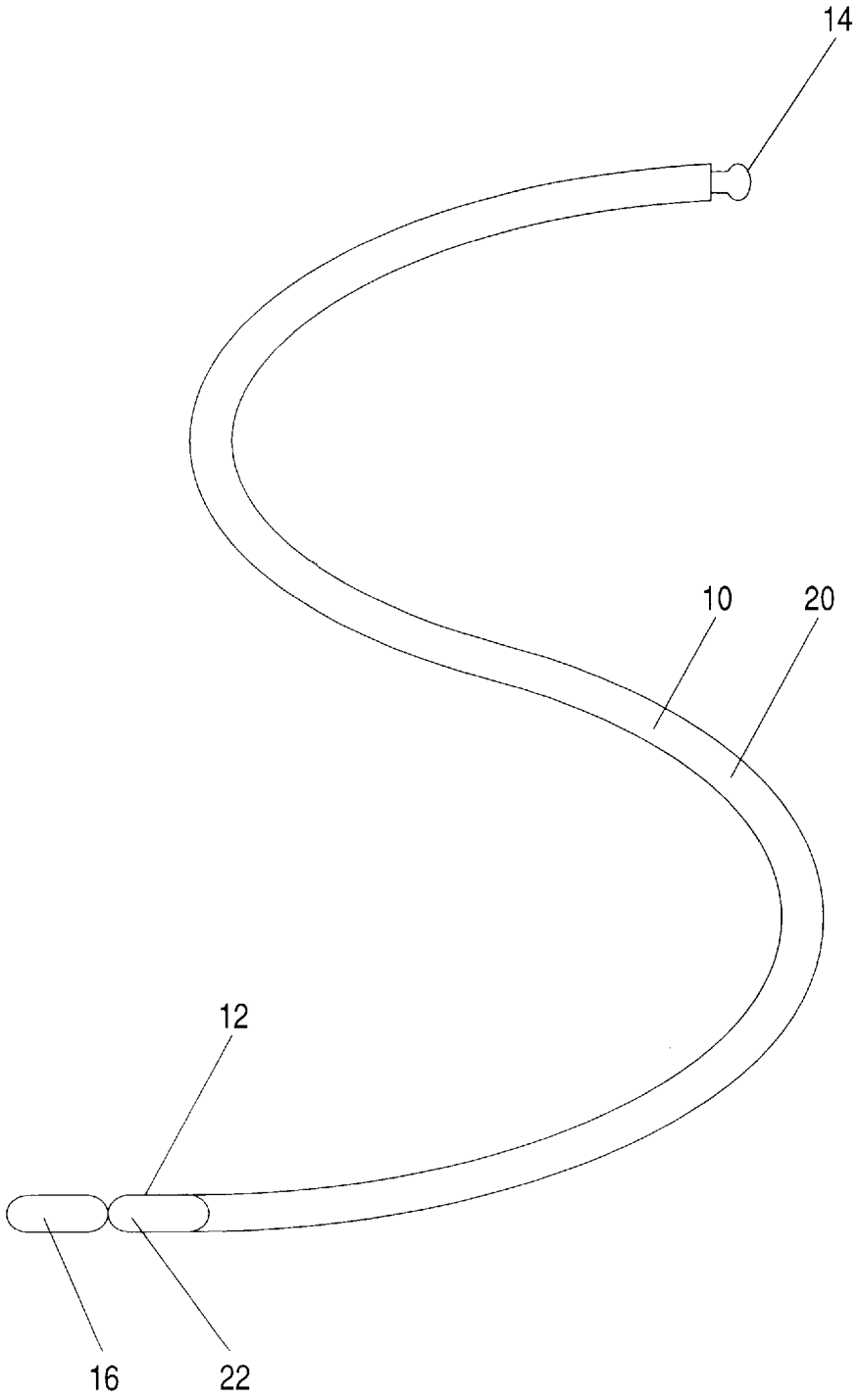
FIG. 1 (prior art) is a cross-sectional view of a luminescent necklace.
Figure 2:
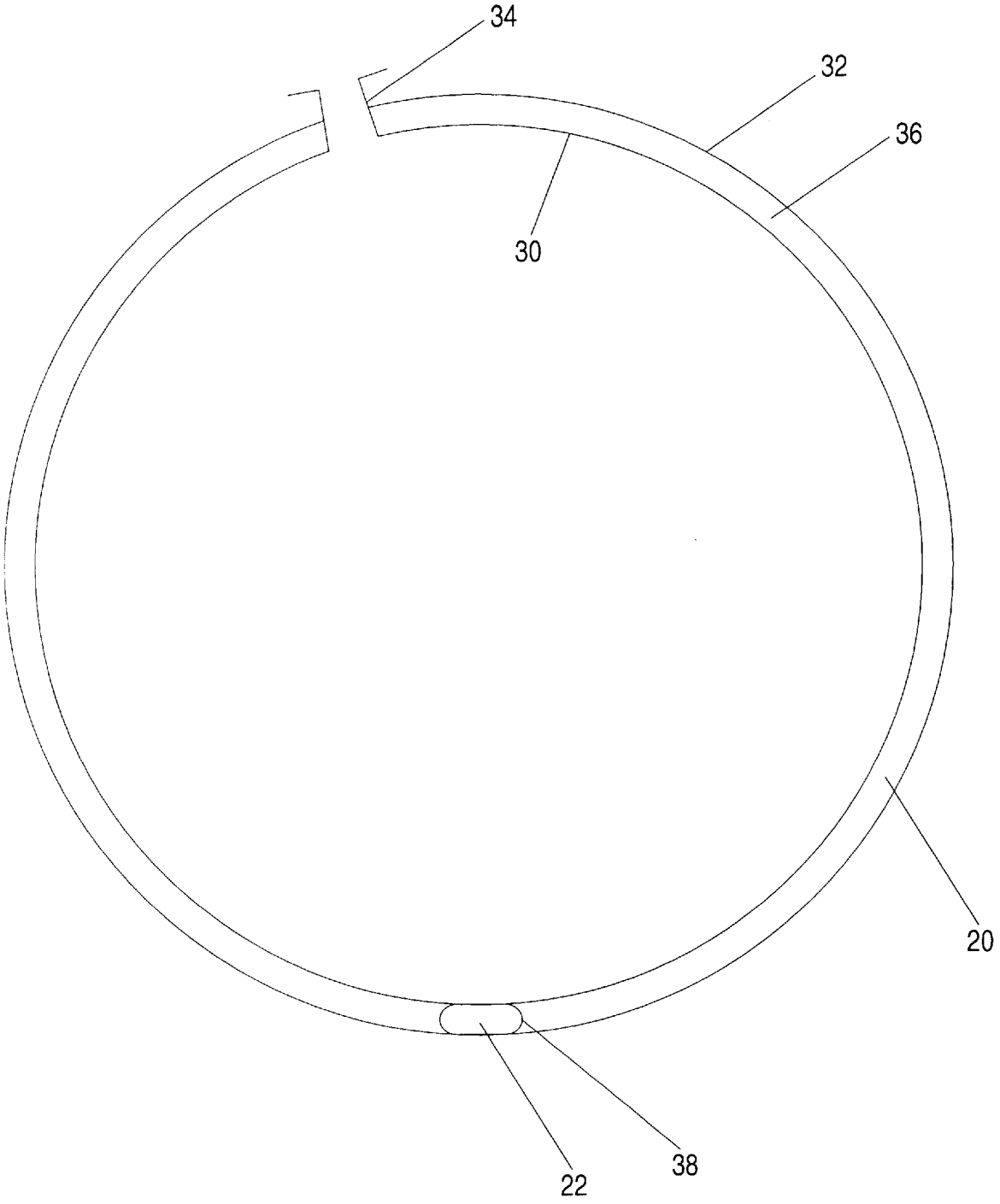
FIG. 2 is a cross-sectional view of one embodiment of the present invention.

Referring now to the drawings, FIG. 2 is a cross-sectional view of one preferred embodiment of the present invention. A transparent outer balloon 32 substantially encloses all inner balloon 30. Both balloons 30 and 32 are of substantially the same shape, but balloon 32 is slightly larger than balloon 30, so that balloons 30 and 32 define between them a chamber 36. Balloon 30 is sealed to balloon 32 at neck 34 of balloon 32 with a liquid-tight seal. Inside chamber 36 is a capsule 38 containing second liquid 22. Capsule 38 is any suitable container of second liquid 22 that can be broken by moderate pressure or moderate shear force to release second liquid 22. For example, capsule 38 may be a fragile capsule similar to capsule 12 of tube 10, or capsule 38 may be a thin-walled pocket fabricated integrally with inner balloon 30 or outer balloon 32. In the latter case, second liquid 22 may be introduced to capsule 38 by injection through a thin hollow needle. The rest of chamber 36 is substantially filled with first liquid 20. The seal at neck 34 between balloons 30 and 32 retains first liquid 20 within chamber 36.

Balloons 30 and 32 are made of the reversibly stretchable materials commonly used in toy balloons. When capsule 38 is broken by moderate external pressure, second liquid 22 emerges from capsule 38 and mixes with first liquid 20, creating a luminescent mixture. The present invention now may be inflated in the conventional manner, for example by blowing air into neck 34 or introducing helium gas under pressure into neck 34, and then sealed for example by tying off neck 34 or by inserting a one-way valve. Using helium gas creates a glowing balloon that is lighter than air and can be released to emulate a UFO.

Figure 3:
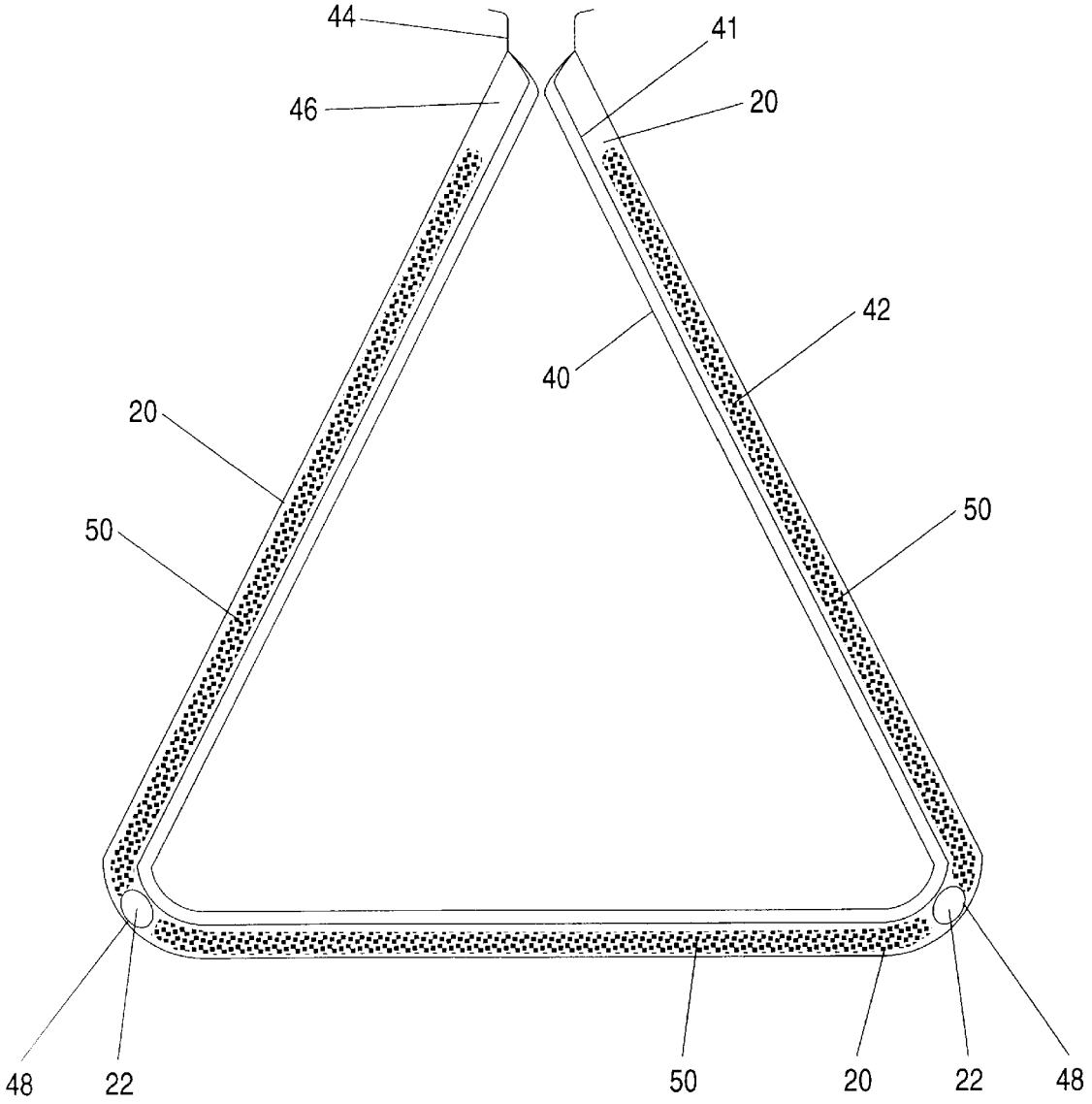
FIG. 3 is a cross-sectional view of another embodiment of the present invention.

FIG. 3 is a cross-sectional view of another embodiment of the present invention. As in the case of the embodiment of FIG. 2, a transparent outer balloon 42 substantially encloses an inner balloon 40. Again, both balloons 40 and 42 are of substantially the same shape, but balloon 42 is slightly larger than balloon 40, so that balloons 40 and 42 define between them a chamber 46. As before, balloon 40 is sealed to balloon 42 at neck 44 of balloon 42 with a liquid-tight seal. In this embodiment, balloon 40 is made of materials that are flexible but not stretchable. Outer surface 41 of inner balloon 40 is metallized, for example with a thin layer of aluminum, as is commonly applied to the type of balloon commonly used to express friendly sentiments.

Within chamber 46 are several capsules 48, similar to capsules 12 and 38, containing second liquid 22. The rest of chamber 46 is substantially filled with a porous flexible spongelike material 50, the pores of which are saturated with first liquid 20. The embodiment of FIG. 3 is used in substantially the same manner as the embodiment of FIG. 2: capsules 48 are broken or torn to release second liquid 22, the embodiment is inflated via neck 44, and neck 44 is tied off or otherwise sealed in a suitable manner. In this embodiment, it generally is necessary to manipulate porous material 50, for example by repeatedly squeezing porous material 50, to get all of first liquid 20 in contact with second liquid 22. To facilitate this, this embodiment is provided with several capsules 48, unlike the embodiment of FIG. 2, in which one capsule suffices.

While the invention has been described with respect to a limited number of embodiments, it will be appreciated that many variations, modifications and other applications of the invention may be made.

What is claimed is:

1. A toy comprising:

(a) an inner balloon;

(b) an outer balloon, substantially enclosing said inner balloon, said inner balloon and said outer balloon defining a chamber therebetween;

(c) a first liquid, within said chamber;

(d) a capsule, within said chamber;

(e) a second liquid, within said capsule; and (f) a porous, flexible material substantially filling said chamber, said first liquid occupying pores of said porous material;

said first liquid and said second liquid being such that when said first liquid and said second liquid are mixed, a glowing mixture is formed.

2. The toy of claim 1, wherein said first liquid includes luminol and said second liquid includes hydrogen peroxide.

3. The toy of claim 1, wherein said outer balloon is made of a substantially transparent material.

4. The toy of claim 1, wherein said inner balloon and said outer balloon are made of a reversibly stretchable material.

5. The toy of claim 1, wherein said inner balloon has a metallized outer surface.

* * * * *